US006855024B2

(12) United States Patent
Rothschild

(10) Patent No.: US 6,855,024 B2
(45) Date of Patent: Feb. 15, 2005

(54) SKIS TO WALK ON WATER

(76) Inventor: Walter G. Rothschild, 409 Wind Haven La., Winston-Salem, NC (US) 27104

( * ) Notice: Subject to any disclaimer, the term of this patent is extended or adjusted under 35 U.S.C. 154(b) by 0 days.

(21) Appl. No.: 10/425,591

(22) Filed: Apr. 29, 2003

(65) Prior Publication Data

US 2003/0203686 A1 Oct. 30, 2003

Related U.S. Application Data

(60) Provisional application No. 60/376,676, filed on Apr. 29, 2002.

(51) Int. Cl.[7] ..... B63B 35/83
(52) U.S. Cl. ..... 441/77
(58) Field of Search ..... 441/76, 77

(56) References Cited

U.S. PATENT DOCUMENTS

| | | | | | |
|---|---|---|---|---|---|
| 216,234 | A | | 6/1879 | Soule | |
| 1,091,259 | A | * | 3/1914 | Voller | 441/77 |
| 1,384,354 | A | * | 7/1921 | Sheldon | 441/77 |
| 1,475,031 | A | * | 11/1923 | Sheldon | 441/77 |
| 1,719,059 | A | | 7/1929 | Krupka et al. | |
| 2,260,057 | A | | 10/1941 | Rydberg | |
| 2,482,074 | A | | 9/1949 | Stephens | |
| 2,940,090 | A | | 6/1960 | Fournier | |
| 2,950,118 | A | | 8/1960 | Sharpe | |
| 3,031,696 | A | | 5/1962 | Brabb | |
| 3,112,504 | A | | 12/1963 | Carlton | |
| 3,324,820 | A | | 6/1967 | Fekete | |
| 3,479,674 | A | | 11/1969 | Beymer | |
| 3,541,623 | A | | 11/1970 | Duda | |
| 3,609,782 | A | | 10/1971 | Mabuchi | |
| 3,756,187 | A | | 9/1973 | Livaudais | |
| 3,775,866 | A | | 12/1973 | Marker | |
| 3,784,216 | A | | 1/1974 | Maier, Jr. | |
| 3,936,897 | A | | 2/1976 | Schaumann | |
| 3,952,353 | A | | 4/1976 | Word | |
| 4,117,562 | A | | 10/1978 | Schaumann | |
| 4,157,597 | A | | 6/1979 | Trebnick | |
| 4,295,236 | A | | 10/1981 | Upchurch | |
| 4,379,701 | A | | 4/1983 | David | |
| 4,459,118 | A | | 7/1984 | Schaumann | |
| 4,527,984 | A | * | 7/1985 | Gilbert | 441/76 |
| 4,541,809 | A | | 9/1985 | Schaumann | |
| 4,591,343 | A | | 5/1986 | Schaumann | |
| 4,599,072 | A | * | 7/1986 | Pollini et al. | 441/65 |
| 4,618,329 | A | | 10/1986 | Celez | |
| 4,624,646 | A | | 11/1986 | Strohmeier | |
| 4,681,551 | A | | 7/1987 | Morris | |
| 4,698,039 | A | | 10/1987 | Watson | |
| 4,731,039 | A | | 3/1988 | Zeiss | |
| 4,772,237 | A | | 9/1988 | Zalkauskas | |
| 4,795,381 | A | | 1/1989 | Willems | |
| 4,804,345 | A | | 2/1989 | Lee | |
| 4,846,743 | A | | 7/1989 | Ping-chuan | |
| 4,915,659 | A | | 4/1990 | Sanders | |
| 4,952,184 | A | | 8/1990 | Graziano | |
| 4,954,106 | A | | 9/1990 | Shuh-Chin | |
| 4,985,006 | A | | 1/1991 | Brunet | |
| 5,080,621 | A | | 1/1992 | Nayes | |
| 5,194,023 | A | | 3/1993 | Stone | |
| 5,236,381 | A | | 8/1993 | Keogh | |

* cited by examiner

*Primary Examiner*—Sherman Basinger
(74) *Attorney, Agent, or Firm*—Kilpatrcik Stockton LLP; Cynthia B. Rothschild

(57) ABSTRACT

The present invention relates to skis that allows a human subject to walk by sliding of the legs back and forth in a motion similar to cross-country snow skis. In an embodiment, the present invention comprises: (a) two skis having a foot-support for the subject to secure a foot on the upper surface of each ski; (b) flaps secured to the bottom of each ski which allow the skis to frictionally interact with the water such that when the subject pushes back on one of the skis, the subject is propelled forward across the water; and (c) a frame connecting the two skis to each other that allows the skis to slide back and forth with respect to one another in a first direction (x) that is parallel to the length of the skis, and also maintains the skis at a constant distance apart from each other in the (y) direction, and at the same depth in the water in the (z) direction.

16 Claims, 3 Drawing Sheets

SKIS TO WALK ON WATER

PRIORITY CLAIM

This application claims the benefit of priority to U.S. Provisional Application Ser. No. 60/376,676, filed Apr. 29, 2002. The disclosure of U.S. Provisional Application Ser. No. 60/376,676 is incorporated by reference in its entirety.

FIELD OF THE INVENTION

The present invention relates to an apparatus that allows a human subject to walk on water. In an embodiment the present invention describes skis that float on top of water and allow the user to engage in self-propelled motion across the water by sliding of the legs back and forth in a motion similar to cross-country snow skis.

BACKGROUND OF THE INVENTION

Water skiing is a popular sport. Still, water skiing is associated with fast speeds and for that reason, is not appealing to many individuals. Also, water skiing requires that the skier have sufficient strength to get up from a sitting position and to be able to hold on to a rope and thereby be pulled behind a boat over the water surface. In addition, water skiing requires a boat having sufficient power to pull the skier over the water. Thus, in addition to requiring sophisticated equipment, the sport requires a particular type of athlete.

The ability to walk on water has intrigued man for millennia. There have been several previous attempts to develop skis that allow for self-propelled motion over the water. Still, none of the self-propelled skis developed to date have proven to commercially viable.

For example, several patents describe skis that are not attached to each other. In this case, the user is susceptible to painful leg splits, as the skis will naturally move away from each other during use. Another disadvantage of a design in which the skis are not connected is that the user has to try to ski with their feet wider apart than the natural position. Cross-country skiers can easily have their feet wide apart or close together, but the natural position seems to be when the centerline of each ski is about shoulder width apart. Patents describing skis that are not attached to each other include U.S. Pat. Nos.: 216,234; 1,719,059; 2,482,074; 3,031,696; 3,479,674; 3,541,623; 3,952,353; 4,117,562; 4,599,072; 4,698,039; 4,618,329; 4,731,039; 4,804,345; 4,952,184; 4,954,106; 4,985,006; 5,080,621; and 5,236,381.

Other products that have been designed to walk on water describe skis that are attached to each other, but require complex, heavy mechanisms to join the skis, or to propel the skis with respect to one another. Patents describing such complex attachment mechanisms include U.S. Pat. Nos.: 2,940,090; 3,324,820; 3,936,897; 4,157,597; 4,459,118; 4,541,809; 4,846,743; and 5,194,023.

Non-motorized water sport products need to be simple and inexpensive to become viable commercial products. Canoes, kayaks, surfboards, wind surfers, and small sail boats all benefit from very simple mechanisms and designs that are easily mass-produced. Thus, there is a need for a simple, lightweight product that allows for a human subject to engage in self-propelled motion across the water. Preferably, the skis to walk on water employ a simple mechanism that provides for skis that are portable, easy to put on and to take off, and allow for easy adjustment by the user.

SUMMARY

The present invention describes skis that allow a user to propel themselves across the surface of water by using a motion similar to cross country skiing. For example, the present invention provides an apparatus for recreational use and fitness training.

Thus, in one aspect, the present invention describes an apparatus for the self-propelled motion of a human subject on water comprising:

(a) a first and second ski, each ski comprising a means of floatation and being longer in length than width, and each ski having a foot-support for the subject to secure a foot along the length of the ski and on the upper surface of each ski, such that said first foot is secured to said first ski and said second foot is secured to the second ski;

(b) flaps secured to the bottom of each ski which allow the skis to frictionally interact with the water with sufficient force such that when the subject pushes back on one of the skis, the subject is propelled forward across the water; and (c) a frame connecting each of the two skis to each other such that the frame allows the skis to slide back and forth with respect to one another in a first direction (x) that is parallel to the length of the skis, and also maintains the skis at a constant distance apart from each other in the (y) direction, and also maintains each skis at the same depth in the water in the (z) direction, such that as the skis move, they are kept parallel to each other in the (x), and (z) directions, and at a constant distance apart in the (y) direction, wherein directions (x), (y), and (z) are each perpendicular to each other.

In another aspect, the present invention comprises an apparatus for the self-propelled motion of a human subject on water comprising:

(a) a first and second floatation means allowing the first and second foot of said subject to float on the water when the subject's first foot is secured to the first floatation means and the subject's second foot is secured to the second floatation means, and wherein the floatation means allow said first and second foot to move separately, such that each foot independently slides back and forth relative to the other foot in a direction (x) which is parallel to the longitudinal axis of the foot;

(b) a means to connect said first and second floatation means, and to maintain said first and said second floatation means parallel to each other in the (x) direction, at a constant distance apart in the (y) direction, and in the correct, upright position in the water in the (z) direction, wherein the (x), (y) and (z) directions are each perpendicular to each other; and (c) a means which allows the flotation means to frictionally interact with the water with sufficient force such that when the subject push back on one of the flotation means, the subject is to propelled forward, in the x direction, across the water.

In yet another aspect, the present invention comprises a method for a human subject walk across the surface of water comprising:

(a) providing an apparatus comprising: (i) a first and second ski, each ski comprising a means of floatation and being longer in length than width, and each ski having a foot-support for the subject to secure a foot along the length of the ski and on the upper surface of each ski, such that said first foot is secured to said first ski and said second foot is secured to the second ski; (ii) flaps secured to the bottom of each ski which allow the skis to frictionally interact with the water with sufficient force such that when the subject pushes back on one of the skis, the subject is propelled forward across the water; and (iii) a frame connecting each of the two skis to each other such that the frame allows the skis to slide back and forth with respect to one another in a first direction (x) that is parallel to the length of the skis, and also maintains the skis at a constant distance apart from each other in the (y) direction, and also maintains each skis at the same depth in the water in the (z) direction, such that as the skis move, they are kept parallel to each other in the (x) and (z) directions, and at a constant distance apart in the (y) direction, wherein directions (x), (y), and (z) are each perpendicular to each other;

(b) having the subject secure one foot on each of the skis; and (c) having the subject push back on one ski, such that the subject moves forward across the water in the (x) direction.

There are, of course, additional features of the invention which will be described hereinafter and which will form the subject matter of the claims appended hereto. It is to be understood that the invention is not limited in its application to the specific details as set forth in the following description and figures. The invention is capable of other embodiments and of being practiced or carried out in various ways.

BRIEF DESCRIPTION OF THE DRAWINGS

Various features, aspects, and advantages of the present invention will become more apparent with reference to the following description and accompanying drawings.

DETAILED DESCRIPTION

Figure 1:
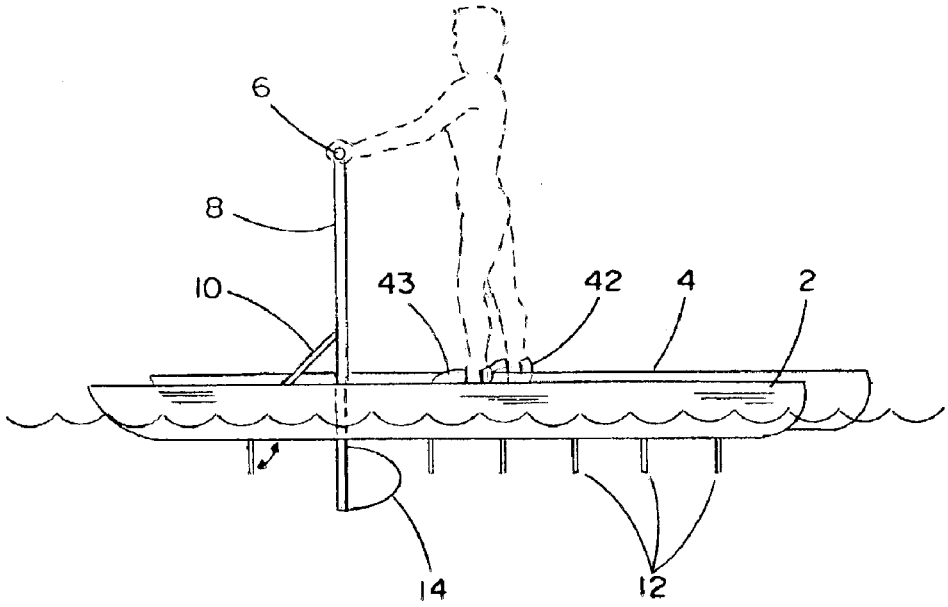
FIG. 1 is a side view showing a human subject using the skis having a handlebar in accordance with an embodiment of the present invention.

The present invention relates to an apparatus that allows a human subject to walk on water. In an embodiment, the present invention describes skis that float on top of water and allow the user to glide across the water by sliding of the legs back and forth in a motion similar to cross-country snow skis.

Thus, in one aspect, the present invention describes, an apparatus for the self-propelled motion of a human subject on water comprising:

(a) a first and second ski, each ski comprising a means of floatation and being longer in length than width, and each ski having a foot-support for the subject to secure a foot along the length of the ski and on the upper surface of each ski, such that said first foot is secured to said first ski and said second foot is secured to the second ski;

(b) flaps secured to the bottom of each ski which allow the skis to frictionally interact with the water with sufficient force such that when the subject pushes back on one of the skis, the subject is propelled forward across the water; and (c) a frame connecting each of the two skis to each other such that the frame allows the skis to slide back and forth with respect to one another in a first direction (x) that is parallel to the length of the skis, and also maintains the skis at a constant distance apart from each other in the (y) direction, and also maintains each skis at the same depth in the water in the (z) direction, such that as the skis move, they are kept parallel to each other in the (x) and (z) directions, and at a constant distance apart in the (y) direction, wherein directions (x), (y), and (z) are each perpendicular to each other.

In an embodiment, the frame comprises a mechanism that has a first moving part that glides in a linear motion in relation to a second part and wherein said first moving part is connected to said first ski and said second part is connected to said second ski. Preferably, the first moving part of the frame that glides in a linear motion in relation to a second part comprises a linear bearing.

Also in an embodiment, the apparatus of the present invention includes an upper body rest to support the upper body of the subject. In a preferred embodiment, the upper body rest may comprise handlebars attached via a shaft to the frame. Also preferably, the upper body rest further comprises a rudder attached to the shaft. Even more preferably, the shaft is freely rotating such that the shaft and attached rudder can be rotated by the user turning on the handle bars.

In an embodiment, there is a rudder attached to at least one ski.

In another embodiment, the flaps on each ski comprise an axel such that the flaps can move from a position that is near horizontal such that the flats are almost parallel with the skis, to a position which is at least near vertical to the skis. Preferably, the flaps are designed such that the total surface area of the flaps under each ski comprises at least 30 square inches.

The foot support may vary depending upon the type of water in which the ski will be used. For example, a more secure foot support may be needed for ocean skiing as opposed to lake skiing. Thus, in an embodiment, the means to secure the subject's foot to at least one of the skis comprises an insert for the toes. Alternatively and/or additionally, the foot-support comprises an insert for the heel.

In an embodiment, the skis further comprise poles having a floatation device on the end of the pole placed in the water. Preferably, the poles have a means to create drag in the water on the end of the pole placed in the water. More preferably, the means to create drag in the water comprises a paddle-like flap at the end of the pole.

In another aspect, the present invention comprises an apparatus for the self-propelled motion of a human subject on water comprising:

(a) a first and second floatation means allowing the first and second foot of said subject to float on the water when the subject's first foot is secured to the first floatation means and the subject's second foot is secured to the second floatation means, and wherein the floatation means allow said first and second foot to move separately, such that each foot independently slides back and forth relative to the other foot in a direction (x) which is parallel to the longitudinal axis of the foot;

(b) a means to connect said first and second floatation means, and to maintain said first and said second floatation means parallel to each other in the (x) direction, at a constant distance apart in the (y) direction, and in the correct, upright position in the water in the (z) direction, wherein the (x), (y) and (z) directions are each perpendicular to each other; and (c) a means which allows the flotation means to frictionally interact with the water with sufficient force such that when the subject push back on one of the flotation means, the subject is to propelled forward, in the x direction, across the water.

In an embodiment, the floatation means comprise skis that float on water.

Also in an embodiment, the means to connect the first and second floatation means comprises a frame connecting each of the two floatation means to each other such that the frame allows each floatation means to slide back and forth with respect to one another in the (x) direction while maintaining the floatation means at a constant distance apart from each other in the (y) direction, and also maintains each floatation means at the same depth in the water in the (z) direction. Preferably, the frame comprises a mechanism that has a first moving part that glides in a linear motion in relation to a second part and wherein said first moving part is connected to said first floatation means and said second part is connected to said second floatation means.

In an embodiment, the means which allows the skis to frictionally interact with the water comprises flaps that can move from a near horizontal position such that the flaps are almost parallel with the surface of the water, to a near vertical position such that the flaps are perpendicular to the surface of the water.

In yet another aspect, the present invention comprises a method for a human subject walk across the surface of water comprising;

(a) providing an apparatus comprising: (i) a first and second ski, each ski comprising a means of floatation and being longer in length than width, and each ski having a foot-support for the subject to secure a foot along the length of the ski and on the upper surface of each ski, such that said first foot is secured to said first ski and said second foot is secured to the second ski; (ii) flaps secured to the bottom of each ski which allow the skis to frictionally interact with the water with sufficient force such that when the subject pushes back on one of the skis, the subject is propelled forward across the water; and (iii) a frame connecting each of the two skis to each other such that the frame allows the skis to slide back and forth with respect to one another in a first direction (x) that is parallel to the length of the skis, and also maintains the skis at a constant distance apart from each other in the (y) direction, and also maintains each skis at the same depth in the water in the (z) direction, such that as the skis move, they are kept parallel to each other in the (x) and (z) directions and at a constant distance apart in the (y) direction, wherein directions (x), (y), and (z) are each perpendicular to each other;

(b) having the subject secure one foot on each of the skis; and (c) having the subject push back on one ski, such that the subject moves forward across the water in the (x) direction.

In an embodiment, the frame comprises a mechanism that has a first moving part that glides in a linear motion in relation to a second part and wherein said first moving part is connected to said first ski and said second part is connected to said second ski. Preferably, the first moving part of the frame that glides in a linear motion in relation to a second part comprises a linear bearing.

Also in an embodiment, the apparatus of the present invention includes an upper body rest to support the upper body of the subject. In a preferred embodiment, the upper body rest may comprise handlebars attached via a shaft to the frame. Also preferably, the upper body rest further comprises a rudder attached to the shaft. Even more preferably, the shaft is freely rotating such that the shaft and attached rudder can be rotated by the user turning on the handle bars.

In an embodiment, there is a rudder attached to at least one ski.

In another embodiment, the flaps on each ski comprise an axel such that the flaps can move from a position that is near horizontal such that the flats are almost parallel with the skis, to a position which is at least near vertical to the skis. Preferably, the flaps are designed such that the total surface area of the flaps under each ski comprises at least 30 square inches.

The foot support may vary depending upon the type of water in which the ski will be used. For example, a more secure foot support may be needed for ocean skiing as opposed to lake skiing. Thus, in an embodiment, the means to secure the subject's foot to at least one of the skis comprises an insert for the toes. Alternatively and/or additionally, the foot-support comprises an insert for the heel.

In an embodiment, the skis further comprise poles having a floatation device on the end of the pole placed in the water. Preferably, the poles have a means to create drag in the water on the end of the pole placed in the water. More preferably, the means to create drag in the water comprises a paddle-like flap at the end of the pole.

Thus, the present invention describes skis that allow a user to propel themselves across the surface of water. In an embodiment, the present invention provides a means by which a subject standing on ski-shaped floatation devices can maneuver the flotation devices in such a manner as to glide across the water using a motion similar to cross country skiing. Various embodiments of the invention are designed to provide stability and ease of motion through the water.

The present invention recognizes that to glide across the water, skis should be maintained at a constant distance apart and parallel to each other along the length of the skis. Also the skis must be maintained in the correct upright position. For example, a person standing on two unattached skis will make the skis become wider apart, causing a painful leg split. In addition, the skis without a support to hold the skis upright and parallel will tend to capsize, since with a user positioned on the upper surface, they will essentially be very top-heavy boats.

Thus, as described herein, the skies are maintained parallel to each other in two directions (x), and (z), and at a constant distance apart in the (y) direction. As described herein, the (x) direction is the direction along the line of motion of the skis as they move through the water. This is also the direction that is parallel to the longest axis of the ski. Also as described herein, the (y) direction is the direction describing the distance between the skis. Also, as described herein, the (z) direction describes the direction that is parallel to the user standing on the ski. When both skis are perfectly flat in the water, the (z) direction is perpendicular to the surface of the water. There will of course be times when one ski is lower in the water, than the other ski. In this case, the (z) direction will be close to vertical, but not exactly perpendicular to the water's surface. In all cases, however, directions (x), (y) and (z) are perpendicular to each other.

Two important mechanical mechanisms allow for the skis of the present invention to work in the intended fashion. The first mechanism is under the water line and facilitates propulsion. The second mechanism holds the skis in a rigid structure, such that the skis are maintained parallel to each other and at a constant distance apart, but still allows them to slide back and forth independently of each other. The second mechanism also holds the skis in a position such that each ski is maintained at a relatively constant depth in the water. For example, in an embodiment, a mechanism comprised of linear motion bearings and a rigid frame is used to keep the skis parallel to each other along the line of motion in the (x) direction, at a constant distance apart in the (y) direction, and in the correct, upright position in the (z) direction.

In an embodiment, a mechanism that has a first moving part that glides in a linear motion in relation to a second part may be used to hold the skis parallel while allowing them to slide back and forth independently. For example, a frame comprising a linear motion bearing may be used to maintain the skis in the correct spatial relationship to one another. A linear motion bearing has a moving part that glides in a linear motion on another part. A sliding door is an example of a linear motion bearing. Linear motion bearings suitable for use in the present invention may comprise of a moving part in a track, a ring sliding on a bar, or two tracks sliding against each other, or the equivalent. The present invention is not limited as to which part is moving and which part is fixed.

When a linear motion bearing is used, the surfaces of the bearings may have ball bearings or static, slippery plastic to minimize the friction. For example, in an embodiment, the present invention comprises interlocking metal channels with ultra-high molecular weight polyethylene wear strips placed on the long edges of the metal channel to act as the bearing surface. This simple linear bearing has the additional advantage of being unlikely to bind or seize due to the fact that the contact surface is the entire length of the ski.

In an embodiment, the mechanism for holding the skis together and parallel is above the water line. For example, having the frame mechanism above the water line would creates less drag than having the mechanism below the water line. Thus, in an embodiment, the frame comprises two sliding linear motion bearings attached to the frame above the water line. To this rigid frame is attached one of the skis. The other ski is attached to the moving part of the linear motion bearings, thereby aligning the two skis into a catamaran arrangement, but still allowing the skis to slide back and forth independently of each other. The linear bearing will need to be long enough to allow for the user to ski in a usual 3 to 6 foot leg motion.

Alternatively, the mechanism for holding the skis together and parallel is below the water line. In yet another embodiment, the frame may comprise one or more linear motion bearing below the water line and one or more above the water line. This is a stable triangle or box like design, but can create drag since part of the mechanism would be under the water. In another embodiment, three or more linear bearings above the water line may be used in a triangle or box arrangement.

In an embodiment, only two linear motion bearings are used. This can be preferable from an economic standpoint. Also, there is a performance incentive to have the skis and mechanism to be as light as possible.

In an embodiment, the skis are approximately the width of a typical water ski. For example, the ski-shaped floatation devices of the present invention can be made using a boat construction techniques standard in the art using materials that range from Styrofoam® billets to fiberglass hulls. Like other types of skis, the skis of the present invention are longer than they are wide.

Still, in yet another embodiment, the skis are considerably wider, such that two skis aligned are wider than shoulder width of the user. Preferably, increasing the width of the skis increases stability of the user trying to float on the skies. This embodiment recognizes that the center of gravity of each foot does not necessarily have to be directly above the center of gravity of each individual ski if the skis are in a wide catamaran arrangement. This arrangement may have the disadvantage, however, of putting a binding torque on the linear motion bearings. Thus, in this embodiment, it is preferable to have more than two linear bearings.

Preferably, the apparatus is designed such that the user's weight is directly over the two skis, and the ski's center of gravity is roughly shoulder width apart. In an embodiment, an outrigger is used to increase stability and to help keep the user from capsizing. For example, in an embodiment, an outrigger comprising struts that extend horizontally from the skis and comprise floatation means that are parallel to the skis was used to increase stability. The outrigger floatation device may be on one or both sides of the skis.

In order for the ski to move forward, a mechanism is required under the water line that allows the skis to be propelled forward more easily than backwards. In cross-country snow skis this is accomplished with waxes or saw tooth like structures on the bottom of the ski. The saw tooth structure typically has a sloped side facing forward and a vertical surface facing the back.

Thus, in an embodiment, flaps on an axel attached to the bottom of the ski provide a frictional interactions that allows the skis to be propelled forward. Other types of hinged arrangements could also be envisioned. In an embodiment, the flaps fold back to a near horizontal position when the ski is propelled forward to minimize drag. When the ski is pushed backward, the flaps catch water and pivot to a vertical position. This vertical position will catch the maximum amount of water, and a simple mechanical "stop" is used to ensure that the flap only extend to the vertical position, and not beyond. In an embodiment, multiple flaps under each ski were successfully employed. In yet another embodiment, a fixed step like mechanism with a sloped plane facing the front of the ski and a vertical plane facing the back of the ski can be used. The number of flaps will vary depending on the size of each flap. Thus, in an embodiment, each ski may comprises from 1–50 flaps. More preferably, each ski may comprise 3–30 flaps, and even more preferably from 5–15 flaps.

There are many types of axel and hinge mechanisms commonly available that are suitable for the flaps on the bottom of the skis of the present invention. In an embodiment, the hinge mechanism that allows the flaps to move from vertical to almost horizontal comprises a Teflon® bushing over both ends of a male, round steel axel, such that the axel and bushing fit into a female socket. Other materials commonly used as equivalents of Teflon® such as polyethylene or metal or plastic ball bearings may also be employed.

The flaps may comprise a central portion which can be extended to provide increased surface area. For example, in an embodiment, a small piece of flat metal was welded to an axel and a paddle was then bolted onto this small flat metal to provide a flap having an enlarged surface area. Thus, in an embodiment, the flaps are made of plastic. Alternatively, the flaps can be made of wood, metal, or other materials having sufficient strength.

In an embodiment, the user's foot is secured to the skis using a mechanism similar to cross-country snow skis. For example, the toe may be fixed to the ski, as the skiing motion is easier if the heel is not fixed. Alternatively, and/or additionally, the skis may have a heel cup or other device in which the subject can rest, or secure, at least one heel.

In an embodiment, the skis have different foot supports on each ski. This may facilitate a secure foot hold on one ski, with easy exit of the other foot for emergency situation. The foot support may be made of synthetic material such as rubber, that is used to attach the foot to water skis, and the like.

In an embodiment, poles are used to provide balance. In an embodiment, the poles comprise a floatation device to allow for support of the user's upper body on the water. For example, in an embodiment the poles have floatable balls (e.g., made of Styrofoam®) on the ends so that the user's weight will be supported. Alternatively, and/or additionally, drag can be added to the poles by attaching any type of article that provides resistance to the bottom of the pole. For example, in an embodiment, a cup is used to create drag. In another embodiment, the poles comprise a flap, or multiple flaps, and thus function as paddles or oars.

In an alternative embodiment, the skis may comprise an upper body rest attached to the frame. Preferably, the rest comprises handle bars and a shaft which attaches to the frame.

Also preferably, the rest may comprise a rope-like handle. Thus, it was found that users preferred pulling on ropes tied to the frame in the front or pulling on handle bars instead of using the poles. Pulling on a handle bar or ropes attached to the frame helped create more leg strength and helped the user balance.

In an embodiment, the handlebars are attached to a rudder for turning. Alternatively, and or additionally, the skis may comprise an independent rudder mechanism attached to the bottom of one or both skis which is independent of the handlebars.

Thus, turning the skis of the present invention can be accomplished in at least four different ways:

(1) The user leaning to one side and thereby applies torque to the skis similar to the force used to turn a kayak, for example, a rudder on the skis or the hull shape of the ski may be used to facilitate turning;

(2) A rudder mechanism which is attached to handle bars or other type of upper body rest;

(3) A mechanism that creates more (or less) drag on the flaps under only one ski; and/or (4) The user dragging one pole having paddles or other type of appendage to create drag on one side of the skis.

The present invention may be further understood by reference to the embodiments shown in the drawings. Thus, FIG. 1 is a side view showing the user standing on top of the skis 2 and 4 and holding onto handlebars 6. The user's feet are attached to the ski with a suitable foot-supports 42 and 43. The foot-supports may comprise a toe cup, a heel cup, or both. The handlebars are on the end of the handlebar stem that also functions as a rudder shaft 8. The handlebar stem/rudder shaft 8 is supported by a handle bar fore brace 10. Under the waterline are the rudder 14 and the hinged flaps 12.

Figure 2:
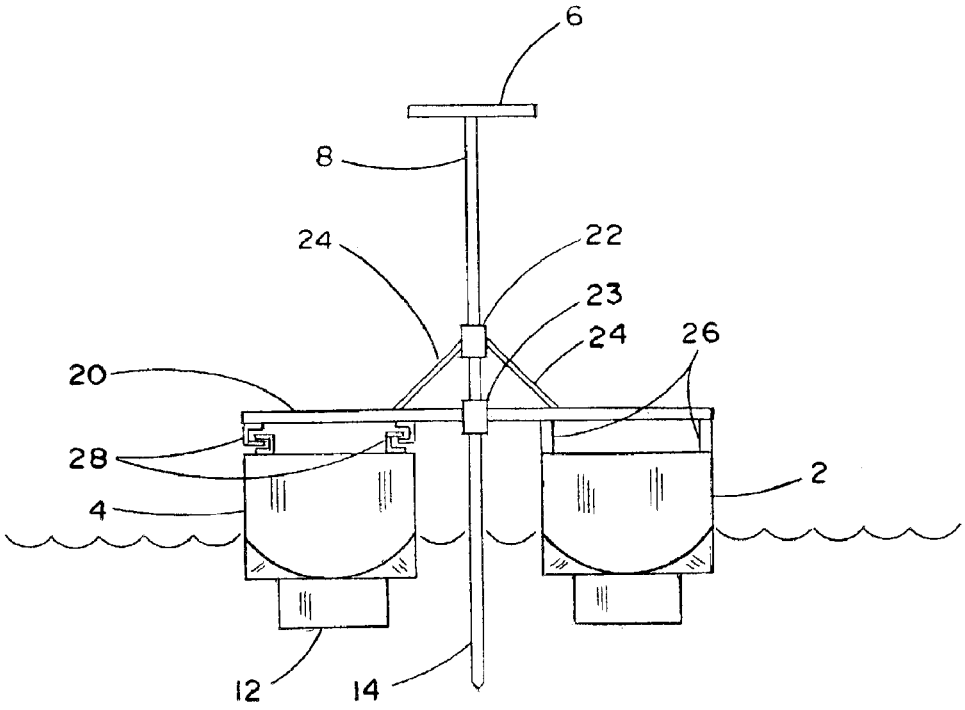
FIG. 2 is a front view of the skis showing spacers which are attached to a lateral frame that maintains the skis parallel with respect to each other in the (x) and (z) directions, and at a constant distance apart in the (y) direction, in accordance with an embodiment of the present invention.

FIG. 2 shows a front view of the skis of the present invention. The left ski 2 is attached via spacers 26 to lateral frame 20. To one of these rigid lateral frame pieces is attached lateral handle bar support braces 24 which are attached to a rudder shaft bushing 22. There is another rudder shaft bushing 23 attached to the rigid lateral frame piece for strength and stability of the handle bar stem/rudder shaft 8. The handlebars 6 are attached to the handlebar stem. The rudder blade 14 is attached to the handlebar stem/rudder shaft. Thus, the direction of the rudder may be adjusted by turning the handlebars 6 which then rotate the shaft 8 and attached rudder 14.

Two interlocking linear bearings 28 allow the right ski 4 to slide fore and aft with the user's cross-country ski motion. These bearings keep the left ski parallel and at a constant, preset distance from the right ski. The frame also holds the skis parallel to each other in the (x) direction along the length of the ski, and in the (z) direction up and down, such the skis are maintained at approximately the same depth in the water. Below the water line are flaps 12.

Having each linear bearing open to the opposite direction prevents the ski which is attached to the frame via a linear bearing from becoming unattached. It does not matter whether the bearings open to the inside or the outside in relation to the ski. In contrast, if both linear bearings open to one side, the ski could slide out of the bearing and thus, become disengaged from the frame.

Figure 3:
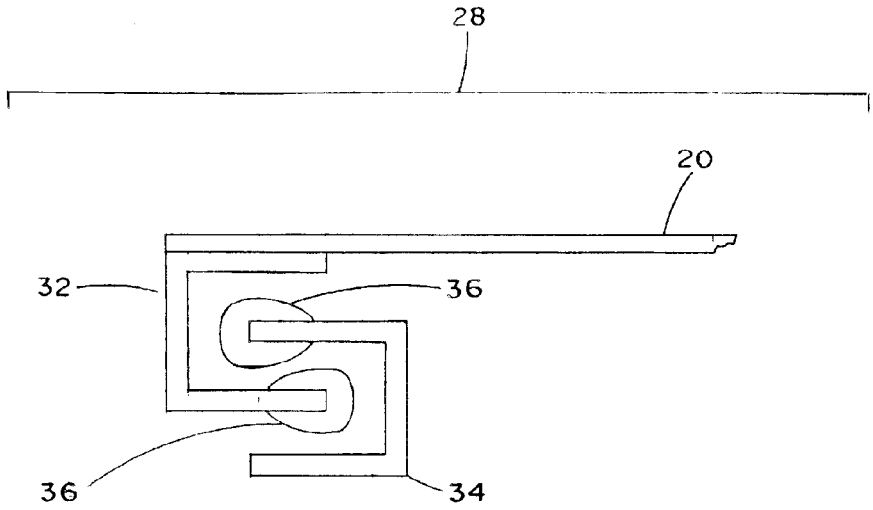
FIG. 3 shows an expanded front view of a linear bearing in accordance with an embodiment of the present invention.

FIG. 3 shows an expanded front view of a linear bearing 28 that may be used in the skis of the present invention. The rigid lateral frame piece 20 attached to one ski (e.g., 4) is attached to metal channel 32. The other arm of this channel is protected by a plastic wear strip 36, which acts as a slippery bearing or bushing. Another metal channel 34 is attached to the other ski 2. The frame is attached to the other ski. Similarly, the other leg of channel 34 is protected by a plastic wear strip 36, which acts as a bushing. Thus, as the linear bearing is in operation, no moving metal surface touches another metal surface. The plastic wear strip protects the metal and provides a slippery surface.

Figure 4:
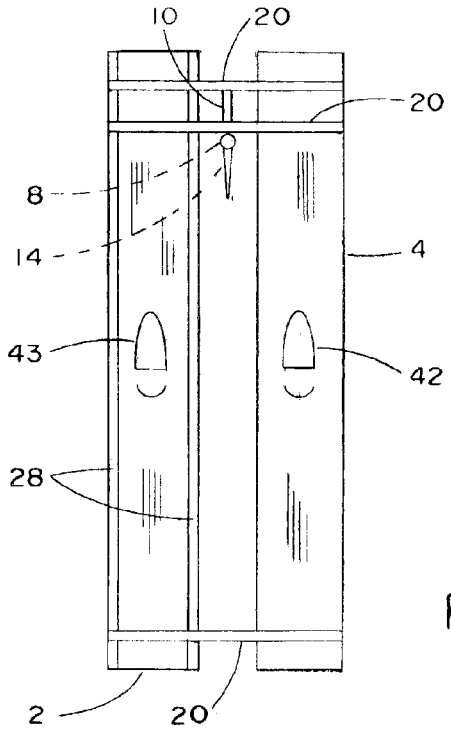
FIG. 4 shows a top view of the skis and lateral frame in accordance with an embodiment of the present invention.

FIG. 4 shows a top view of left ski 2 and right ski 4. In this case, the rigid lateral frame pieces 20 are attached to the right ski 4 and the linear bearings are on the left ski 2. Thus, it does not matter which ski has the linear bearing and which ski has the rigid frame. The handlebar fore brace 10, handlebar stem/rudder shaft 8, and rudder 14 is also attached using bushings and previously described in FIG. 2. The linear bearings 28 are shown to be about the same length as the skis. The foot holding device 42 is near the middle of each ski. Optional, outrigger floats for user stability can be installed by extending the rigid lateral frame pieces 20 over the water on both sides.

EXAMPLE

A working prototype of the skis of the present invention was made of readily available materials. Almost all materials used could be replaced with lighter, stronger components that would create less drag when in contact with water.

Each ski was made of Styrofoam® billets cut to 10 in width by 8.5 in high by 8 ft long. Alternatively, fiberglass can be used, as fiberglass would have much less drag in water. All frame members were made of perforated steel angles and flats that varied from 1/32" to 3/32" thick with 1" or 2" widths. The perforated steel made modifications and bolting parts together easy for the prototype since the holes are already there.

To allow for the frame to be attached to the Styrofoam® skis, each Styrofoam® billet was enclosed in a steel exoskeleton, made with four steel angles placed on the long edges of each ski, with the four steel angles held together by steel flats. As described herein, a steel angle is a piece of steel formed as a 90 degree angle. The steel angles used for the frame had each side being 1 inch wide (1/32 inch thick steel was used). Steel flats as described herein are simply flat pieces of steel. For the frame used in this embodiment, the steel flats were ¾ to 2 inches wide, and the length was equal to either the width, or the height of the ski, depending which side of the ski the flat was on. This created a steel frame around each ski. Such an exoskeleton would not be required with skis, such as fiberglass or wood skis, that allow for direct attachment of the frame.

The foot bindings, linear bearings, rigid lateral frame pieces, and flap assemblies were bolted to the exoskeleton of one or both of the skis. As assembled, the skis had a gap between them of approximately 3.5" and the overall width was approximately 23.5". Optional outriggers were made with perforated steel angles and Styrofoam®.

The linear bearings were 7 ft long and were made with aluminum channel with an overall outside dimensions of 0.75" by 0.75" and metal thickness of 0.125". The wear strips were ultra-high molecular weight polyethylene that had a gap of 0.125", an outside width of 0.375", and height of 0.5". The linear bearings had aluminum tabs welded to them, and they were bolted to perforated steel angles for strength. The linear bearings were fit together in an interlocking position so the skis stayed together at a constant distance and were parallel at all times.

The flaps under the water line were made with a round stainless steel axel having a 0.25" diameter by 2.25" length. To this axel was welded a 1.5" by 6" plate that overlapped the axel 1.125" on one side and 4.875" on the other side, and to this plate were bolted flaps made of lighter material. The female socket for this axel was made from the socket end of a 7/16" by 1.5" socket head cap screw. The bushing was made from Teflon® with an inner diameter of 0.25" and an outer diameter of 0.375" that fits over the end of the axel and into the socket of the socket head cap screw. The threaded ends of the socket head cap screws were supported with thin 7/16" nuts in an aluminum channel that is 4" wide with 2" legs and 0.125" thick. Small bolts were put in the bottom of the channel to act as "stops" to prevent the flaps from moving past the vertical position where they catch the maximum amount of water. The flaps themselves rest on the legs of the channel in a near horizontal position. It is not desirable for the flaps to be completely horizontal because of the need to catch a little water when the ski is moved aft so the flaps will move to the vertical position.

What is claimed is:

1. An apparatus for the self-propelled motion of a human subject on water comprising:

(a) a first and second ski, each ski comprising a means of floatation and being longer in length than width, and each ski having a foot-support for the subject to secure a foot along the length of the ski and on the upper surface of each ski, such that the first foot is secured to the first ski and the second foot is secured to the second ski;

(b) flaps secured to the bottom of each ski which allow the skis to frictionally interact with the water with sufficient force such that when the subject pushes back on one of the skis, the subject is propelled forward across the water; and (c) a frame extending from the first ski to the second ski, and connecting each of the two skis to each other such that the frame allows the skis to slide back and forth with respect to one another in a first direction (x) that is parallel to the length of the skis, and also maintains the skis at a constant distance apart from each other in the (y) direction, and also maintains each skis at substantially the same depth in the water in the (z) direction, such that as the skis move, they are kept parallel to each other in the (x) and (z) directions, and at a constant distance apart in the (y) direction, wherein directions (x), (y), and (z) are each perpendicular to each other, and wherein the frame is connected to the first ski by at least one spacer fixed with respect to the first ski, and the frame is connected to the second ski by a first part that is connected to the frame and a second part that is connected to the second ski, wherein the first part slides in a linear motion in relation to the second part, such that only the second ski moves relative to the frame.

2. The apparatus of claim 1, wherein the first part that slides in a linear motion in relation to the second part comprises a linear bearing.

3. The apparatus of claim 1, further comprising an upper body rest to support the upper body of the subject.

4. The apparatus of claim 3, wherein the upper body rest comprises handlebars attached via a shaft to the frame.

5. The apparatus of claim 4, wherein the upper body rest further comprises a rudder attached to the shaft.

6. The apparatus of claim 5, wherein the shaft is freely rotating such that the shaft and attached rudder can be rotated by the user turning on the handle bars.

7. The apparatus of claim 1, comprising a rudder attached to at least one ski.

8. The apparatus of claim 1, wherein the flaps comprise an axel such that the flaps can move from a position that is near horizontal such that the flaps are almost parallel with the skis, to a position which is at least near vertical to the skis.

9. The apparatus of claim 1, wherein the total surface area of the flaps under each ski comprises at least 30 square inches.

10. The apparatus of claim 1, wherein the foot-support to secure the subject's foot to at least one of the skis comprises an insert for the toes.

11. The apparatus of claim 1, wherein the foot-support to secure the subject's foot to at least one of the skis comprises an insert for the heel.

12. An apparatus for the self-propelled motion of a human subject on water comprising:

(a) a first and second floatation means allowing the first and second foot of the subject to float on the water when the subject's first foot is secured to the first floatation means and the subject's second foot is secured to the second floatation means, and wherein the floatation means allow the first and second foot to move separately, such that each foot independently slides back and forth relative to the other foot in a direction (x) which is parallel to the longitudinal axis of the foot;

(b) a frame that extends from the first floatation means to the second floatation means to connect the first and second floatation means, and to maintain the first and the second floatation means parallel to each other in the (x) direction, at a constant distance apart in the (y) direction, and in a substantially upright position in the water in the (z) direction, wherein the (x), (y) and (z) directions are each perpendicular to each other, and wherein the frame is connected to the first floatation means by at least one spacer fixed with respect to the first floatation means, and the frame is connected to the second floatation means by a first part that is connected to the frame and a second part that is connected to the second floatation means, wherein the first part slides in a linear motion in relation to the second part, such that only the second floatation means moves relative to the frame; and (c) a means which allows the floatation means to frictionally interact with the water with sufficient force such that when the subject pushes back on one of the floatation means, the subject is to propelled forward, in the x direction, across the water.

13. The apparatus of claim 12, wherein the floatation means comprise skis that float on water.

14. The apparatus of claim 13, wherein the means which allows the skis to frictionally interact with the water comprises flaps, that can move from a near horizontal position such that the flaps are almost parallel with the surface of the water, to a near vertical position such that the flaps are perpendicular to the surface of the water.

15. The apparatus of claim 12, wherein the frame connecting each of the two floatation means to each other allows each floatation means to slide back and forth with respect to one another in the (x) direction while maintaining the floatation means at a constant distance apart from each other in the (y) direction, and also maintains each floatation means at substantially the same depth in the water in the (z) direction.

16. A method for a human subject walk across the surface of water comprising;

(a) providing an apparatus comprising: (i) a first and second ski, each ski comprising a means of floatation and being longer in length than width, and each ski having a foot-support for the subject to secure a foot along the length of the ski and on the upper surface of each ski, such that the first foot is secured to the first ski and the second foot is secured to the second ski; (ii) flaps secured to the bottom of each ski which allow the skis to frictionally interact with the water with sufficient force such that when the subject pushes back on one of the skis, the subject is propelled forward across the water; and (iii) a frame extending from the first ski to the second ski, and connecting each of the two skis to each other such that the frame allows the skis to slide back and forth with respect to one another in a first direction (x) that is parallel to the length of the skis, and also maintains the skis at a constant distance apart from each other in the (y) direction, and also maintains each skis at substantially the same depth in the water in the (z) direction, such that as the skis move, they are kept parallel to each other in the (x) and (z) directions and at a constant distance apart in the (y) direction, wherein directions (x), (y), and (z) are each perpendicular to each other, and wherein the frame is connected to the first ski by at least one spacer fixed with respect to the first ski, and the frame is connected to the second ski by a first part that is connected to the frame and a second part that is connected to the second ski, wherein the first part slides in a linear motion in relation to the second part, such that only the second ski moves relative to the frame (b) having the subject secure one foot on each of the skis; and (c) having the subject push back on one ski, such that the subject moves forward across the water in the (x) direction.

* * * * *

UNITED STATES PATENT AND TRADEMARK OFFICE

CERTIFICATE OF CORRECTION

PATENT NO. : 6,855,024 B2
DATED : February 15, 2005
INVENTOR(S) : Walter G. Rothschild It is certified that error appears in the above-identified patent and that said Letters Patent is hereby corrected as shown below:

Title page,
Item [76], Inventors, the phrase "409 Wind Haven La" should read -- 409 Wind Haven Lane --
Item [56], References Cited, U.S. PATENT DOCUMENTS, "4,846,743 A, 7/1989, Ping-chuan" should read -- 7/1987, Ping-chaun et al --

Column 4,
Line 25, the word "flats" should read -- flaps --

Column 6,
Line 3, the word "flats" should read -- flaps --

Column 7,
Line 33, the word "creates" should read -- create --
Line 67, the word "skies" should read -- skis --

Column 8,
Lines 49 and 51, the word "Teflon®" should read -- TEFLON® --

Column 9,
Line 11, the word "Styrofoam®" should read -- STYROFOAM® --

Column 10,
Lines 45, 53 and 54, the word "Styrofoam®" should read -- STYROFOAM® --

Column 11,
Line 6, the word "Styrofoam®" should read -- STYROFOAM® --

UNITED STATES PATENT AND TRADEMARK OFFICE

CERTIFICATE OF CORRECTION

PATENT NO. : 6,855,024 B2
DATED : February 15, 2005
INVENTOR(S) : Walter G. Rothschild It is certified that error appears in the above-identified patent and that said Letters Patent is hereby corrected as shown below:

Column 11 (cont'd),
Line 24, the word "Teflon®" should read -- TEFLON® --

Signed and Sealed this

Fifth Day of July, 2005

JON W. DUDAS
*Director of the United States Patent and Trademark Office*